United States Patent [19]

Scheffee

[11] Patent Number: 4,498,906

[45] Date of Patent: Feb. 12, 1985

[54] COAL-WATER FUEL SLURRIES AND PROCESS FOR MAKING

[75] Inventor: Robert S. Scheffee, Lorton, Va.

[73] Assignee: Atlantic Research Corporation, Alexandria, Va.

[21] Appl. No.: 368,921

[22] Filed: Apr. 16, 1982

Related U.S. Application Data

[63] Continuation-in-part of Ser. No. 360,523, Mar. 22, 1982, Pat. No. 4,465,495, which is a continuation-in-part of Ser. No. 197,853, Oct. 17, 1980, abandoned.

[51] Int. Cl.[3] ..... C10L 1/32

[52] U.S. Cl. ..... 44/51; 406/47; 406/49; 406/197

[58] Field of Search ..... 44/51; 406/47, 49, 197

[56] References Cited

U.S. PATENT DOCUMENTS

| | | | |
|---|---|---|---|
| 2,359,325 | 10/1944 | McConnell et al. | 44/51 |
| 3,019,059 | 1/1962 | McMurtie | 406/49 |
| 3,168,350 | 2/1965 | Phinney et al. | 44/51 |
| 4,104,035 | 8/1978 | Cole et al. | 44/51 |
| 4,217,109 | 8/1980 | Siwersson et al. | 44/51 |
| 4,261,701 | 4/1981 | Shultz et al. | 44/51 |
| 4,282,006 | 8/1981 | Funk | 44/51 |
| 4,302,212 | 11/1981 | Yamamura et al. | 44/51 |
| 4,304,572 | 12/1982 | Wiese et al. | 44/51 |
| 4,403,997 | 9/1983 | Poetschke | 44/51 |

*Primary Examiner*—William R. Dixon, Jr.
*Assistant Examiner*—Margaret B. Medley
*Attorney, Agent, or Firm*—Martha L. Ross

[57] ABSTRACT

Coal-water fuel slurries having long-term storage stability and improved viscosities and comprising finely-divided coal within efficient combustion size range, water, and minor amounts of alkali metal salts of organic dispersants and alkaline earth metal salts of organic dispersants, and process for making such slurries.

68 Claims, No Drawings

COAL-WATER FUEL SLURRIES AND PROCESS FOR MAKING

RELATED APPLICATIONS

This application is a continuation-in-part of copending application Ser. No. 360,523 filed Mar. 22, 1982, now U.S. Pat. No. 4,465,495, which is a continuation-in-part of application Ser. No. 197,853 filed Oct. 17, 1980 abandoned.

BACKGROUND

A high fuel value coal-water slurry which can be injected directly into a furnace as a combustible fuel can supplant large quantities of expensive fuel oil presently being used by utilities, factories, ships, and other commercial enterprises.

For many years, coal-water slurries have been successfully transported long distances by pipeline to point of use, such as a utility. Since practical, cost-effective pipeline slurries do not possess the requisite characteristics for efficient use as fuels, present practice is to dewater, grind the dried coal cake to finer particle sizes, and spray the dried solid particles into the combustion chamber.

Pipeline and fuel coal-water slurries differ markedly in required characteristics because of their different modes of use.

For efficient, low-cost service, slurries which are pumped through pipelines for long distances should have the lowest possible viscosities and rheology which is preferably Newtonian with zero or negligible yield point. In practice, these requirements are achieved by coal concentrations which are considerably smaller than those desired in the fuel slurry. Particle sizes in the upper end of the size distribution range are excessively large for efficient combustion. A typical long-distance pipeline slurry containing no dispersant has a coal concentration of about 40 to 50% and a particle size distribution of 8M×0 (U.S. Standard Sieve) with about 20% being −325M.

A great deal of work has been done to make possible higher loadings in pipelinable slurries by adding a suitable organic dispersant which reduces viscosity and improves particle dispersion. A dispersant which has been of particular interest is an anionic compound in which the anion is a high molecular weight organic moiety and the cation is monovalent, e.g., an alkali metal, such as Na or K. The anion attaches to the coal particles to give them a high negative charge or zeta potential, which causes repulsion sufficient to overcome Van der Waal's attraction and, thereby, prevent flocculation with concomitant reduction in viscosity. In accordance with DLVO theory, small monovalent cations maximize the desired negative zeta potential. This phenomenon is discussed in Funk U.S. Pat. No. 4,282,006, which also advises against the use of multivalent cations because they act as counterions which disadvantageously reduce zeta potential. The monovalent salt dispersants have been found to give essentially zero yield points. Pipeline slurries, including those containing the anionic alkali metal organic dispersants, when at rest, tend to separate gravitationally in a short period of time into supernatant and packed sediment which is virtually impossible to redisperse.

For efficient practical use as a fuel, the slurry must have several essential characteristics. It must have long-term static stability so that it can be stored for extended periods of time by suppliers or at the point of use. During such storage, they must remain uniformly dispersed or, at most, be subject to some soft subsidence which can be easily redispersed by stirring. By subsidence is meant a condition in which the particles do not segregate, as in sedimentation, but remain dispersed in the carrier fluid in a gel or gel-like formation. Uniform dispersion is essential for reliably constant heat output. Coal loadings must be sufficiently high, e.g., up to 65 to 70% or higher, to produce adequate fuel value despite the presence of the inert water carrier. The coal particles must be small enough for complete combustion in the combustion chamber. The slurry must also be sufficiently fluid to be pumped to and sprayed into a combustion chamber. However, the low viscosities required for pipelinable slurries are not required for a fuel slurry. Such fuel slurries have eluded the commercial art.

It is obvious that a process which can convert coal directly into a fuel slurry or transform pipeline slurry at its terminal into a fuel slurry having the aforedescribed characteristics without requiring dewatering the coal to dryness would be most advantageous.

Coal-water slurries which have the aforesaid requisite properties for effective use as fuels which can be used as a substitute for fuel oil are disclosed in copending Robert S. Scheffee patent applications Ser. No. 197,853 and 360,523, the teachings of which are hereby incorporated by reference. These applications teach the use of alkaline earth metal organosulfonate dispersants to form stable coal-water fuel slurries which have coal-loading capacity as high as 70% or more and particular bimodal particle size distributions. The divalent metal salt acts both as dispersant and slurry stabilizer. The fuel slurries are thixotropic or Bingham fluids which have yield points; become fluid and pourable under relatively small stresses to overcome the yield point; and have the long-term static stability required for a practical fuel. The viscosities of these slurries, though not excessively large for handling and use, are considerably higher than those obtained with the alkali metal salts.

Fuel slurries, such as those prepared in accordance with the present invention, which have substantially lower viscosities than those obtained with the divalent salts alone, while retaining the same long-term static stability and other properties required for use as a fuel, have important advantages in terms of ease of handling and power consumption.

Generally, the prior art has focused on reducing viscosity and, thereby, increasing loadings and pumpability of pipeline slurries. The art has taught the use of anionic alkali metal and alkaline earth metal organic dispersants as equivalents for these objectives, and has shown the alkali metal dispersants to be superior. None of the references teach or suggest the unique capability of the alkaline earth metal salts as long-term static stabilizers or their combination with alkali metal salt derivatives to produce the stable fuel slurries of the present invention. References of interest include Wiese et al. U.S. Pat. No. 4,304,572 and Cole et al. U.S. Pat. No. 4,104,035 which disclose the use of alkali metal or alkaline earth metal salts of organosulfonic acids to improve slurry loading and pumpability. In both cases the data show the alkali metal salts to be superior for the stated objectives.

SUMMARY

Fuel slurries comprising up to about 70% or higher of coal stably dispersed in water are produced by admixing finely-divided coal, water, a minor amount of anionic alkali metal salt organic dispersant, and a minor amount of anionic alkaline earth metal salt organic dispersant.

The coal particle sizes should be within a range small enough for efficient combustion; 100% of the coal should be −50M (−297μ) and at least 50% −200M. Preferably, at least about 65% is −200M. A particularly suitable coal size distribution is prepared from a bimodal mixture comprising about 10 to 50% wt.%, preferably 10 to 30 wt.% on slurry, of particles having a size up to about 30μ MMD (mass median diameter), preferably about 1 to 15μ MMD, as measured by a forward scattering optical counter, with the rest of the coal being larger particles having a size range of about 20 to 200μ MMD, preferably about 20 to 150μ MMD. Crushed coal can be ground in known manner to produce the particle sizes required for preparation of the fuel slurries.

The actual degree of coal loading is not critical so long as it is sufficient to provide adequate heat output. The maximum concentration of coal successfully incorporated into a given slurry may vary with such factors as particle size distribution, the particular dispersants used and their total and relative concentrations.

As disclosed in application Ser. No. 197,853 the alkaline earth metal salt organic dispersant is added to the slurry in an amount sufficient to impart a substantial yield point and to maintain the slurry in stable dispersion for extended storage periods without separation of the coal particles into packed sediment.

The alkali metal salt organic dispersant is added to the slurry in an amount sufficient to impart substantially reduced viscosity insert as compared with that imparted by the alkaline earth metal salt organic dispersant alone. As will be seen from the Examples, the slurries containing only the alkali metal salt generally do not have a yield point.

Also as disclosed in application Ser. No. 197,853 long-term static stability requires either a thixotropic or Bingham fluid with an appreciable yield point. The optimum amount of the combination of the alkaline earth and alkali metal organic dispersants which will accomplish the desired long term stability results without excessive increase in yield point or viscosity can readily be determined by routine tests to determine yield point and viscosity in which the amounts and ratios of the alkali metal and alkaline earth metal salt dispersants are varied.

It is believed that the relative proportions of the available alkali metal and alkaline earth metal cations provided by the respective dispersants play an important role in imparting stability and determining yield point and viscosity. However, so many other factors, such as the particular coal, the particular particle size distribution, and the particular dispersant anions, also effect rheological properties in varying and generally unquantifiable degree, that it is difficult to specify generically an optimum ratio of the mono- and divalent cations which would necessarily apply to different specific slurries. In general, however, a ratio in mmols/100 g coal of the monovalent to divalent cations, e.g., $Na^{+}:Ca^{++}$, equal to or smaller than 2:1, produces stable soft gels, with increase in yield point and viscosity as the proportion of multivalent ions increases.

The anionic alkali metal (e.g., Na, K) and anionic alkaline earth metal (e.g., Ca, Mg) organic dispersants preferably have organic moieties which are multifunctional and high molecular weights, e.g., about 1,000 to 25,000. Examples of useful dispersants include organosulfonates, such as the Na lignosulfonates, Na naphthalene sulfonates, Ca lignosulfonates, and Ca napthalene sulfonates, and organo carboxylates, such as Na lignocarboxylate. The alkali metal and alkaline earth metal organosulfonate are preferred. The total amount of the two types of dispersant used is minor, e.g., about 0.1 to 5 pph coal, preferably about 0.5 to 2 pphc.

In some cases, it may be desirable to add an inorganic alkali metal (e.g., Na, K) salt or base to control pH of the slurry in the range of about pH 4 to 11. This may improve aging stability, pourability, and handling characteristics of the slurry. The salt, such as sodium or potassium phosphate, including their acid salts, or the base, such as NaOH or KOH, is used in minor amounts sufficient to provide the desired pH, e.g., about 0.1 to 2% based on the water. The inorganic salts also serve to reduce gaseous sulfur pollutants by forming non-gaseous sulfur compounds. Other additives which may be included are biocides and anti-corrosion agents.

The finely-divided coal particles, water, and dispersants are mixed in a blender or other mixing device which can deliver high shear rates. High shear mixing, e.g., at shear rates of at least about 100 $sec^{-1}$, preferably at least about 500 $sec^{-1}$, as disclosed in parent application Ser. No. 197,853 is essential for producing a stable slurry free from substantial sedimentation.

The slurries can generally be characterized as either thixotropic or Bingham fluids having a yield point. When at rest, the slurries may gel or flocculate into nonpourable compositions which are easily rendered fluid by stirring or other application of relatively low shear stress sufficient to overcome the yield point. They can be stored for long periods of time without separation into packed sediment. They may exhibit some soft subsidence which is easily dispersed by stirring. Slurries embodying these characteristics are included in the term "in stable static dispersion" as employed in the specification and claims. The slurries can be employed as fuels by injection directly into a furnace previously brought up to ignition temperature of the slurry.

In addition to preparing the stable fuel slurry directly from dry coal ground to the desired particle sizes as aforedescribed, the invention can be employed to convert a pipeline slurry at its destination into a fuel slurry and, thereby, eliminate the present costly requirement for complete dewatering. The process of the invention is highly versatile and can be applied to a wide variety of pipeline slurries.

The details of the conversion process are determined by the make-up of the particular pipeline slurry. As aforedescribed, pipeline slurries generally have lower coal concentrations and larger particle sizes than are required for effective fuel use and may or may not include a viscosity-reducing alkali metal salt organic dispersant.

In the case of pipeline slurries which do not contain dispersant, the following procedures can be used:

Coal concentration can be increased to fuel use requirements by partial dewatering or by addition of coal. After such adjustment, the slurry is passed through a comminuting device, such as a ball mill, to reduce the coal particles to the desired fuel size. It should be noted that increasing concentration by coal addition can be done after ball milling, but preferably precedes it.

Addition of the alkali metal and alkaline earth metal organic dispersants can be done after the milling. Preferably at least some to all of the alkali metal or alkaline earth metal dispersant or some to all of both are added to the coal-water slurry prior to milling. When only a portion of the dispersant(s) is added during milling, the remainder is added subsequently, together with any other additives such as biocides, buffer salts, bases, and the like. The slurry mixture is then subjected to high shear mixing, as aforedescribed. The amount and ratio of total alkali metal and alkaline earth metal dispersants added for optimum stability, viscosity, and yield point are determined by routine tests as aforedescribed.

In the case of pipeline slurries which include an alkali metal organic dispersant to reduce viscosity and increase coal concentration, the following procedures can be used:

If the coal concentration is inadequate for fuel use, it can be adjusted by partial dewatering or addition of coal. If coal concentration in the pipeline slurry is adequate, this step can be omitted. Generally, coal particle sizes are larger than desired for fuel use for reasons of reducing viscosity, so that the slurry requires passage through a milling device. The slurry contains its original alkali metal organic dispersant which assists in the milling procedure. Some or all of the alkaline earth metal dispersant can also be added to the wet milling process.

After determination of the concentration of alkali metal salt dispersant in the pipeline slurry, the optimum amount of alkaline earth metal dispersant and any additional alkali metal dispersant required is determined by routine test. After addition of dispersant and any other desired additives, such as biocides, buffer compounds, bases, and anti-corrosion agents, the slurry mixture is subjected to high shear mixing.

The fuel slurries made from the long-distance pipeline slurries are substantially the same as those produced directly from dry coal.

DETAILED DESCRIPTION

Example 1

A series of slurries containing 65% by weight of Kentucky bituminous coal was prepared with 1.0 pph coal, (0.65% slurry) of a mixture of Na and Ca lignosulfonates and with 0.5 and 1.0 pphc of the Na or Ca dispersant only. The coal was a bimodal blend comprising 70% of a coarse fraction having an MMD of 110μ and a maximum size of about 300μ and 30% of a fine fraction having an MMD ranging from about 5 to 10μ (45.5 and 19.5% respectively by weight of slurry). The size consist of the blend was 58% −200M.

The larger particle sizes were determined by sieving. Sub-sieve particle sizes were determined by a forward scattering optical counter which is based on Fraunhofer plane diffraction.

The coarse fraction was prepared by hammermilling and sieving through a 50 mesh screen. The fine grind was prepared by wet ball milling for 2 hours. Except for run MR-16 which was made without any dispersant, all of the wet ball milling was done with at least a portion of dispersant. All of the ball mill runs were made with a 50% coal mill base, the remainder being dispersant and water. Runs N11-1, MR-1-4, and MR-6-8 were milled with Na dispersant; runs 9–11, with a portion of both Na and Ca dispersant, and runs 12 and 13 with a portion of the Ca dispersant. Preferably, though not essentially, the coal is milled with water so that the very fine particles are in water slurry when introduced into the mixer. At least some of the dispersant is included in the ball milling operation to improve flow and dispersion characteristics of the fine particle slurry.

The fuel slurry blends were prepared by mixing the coarse fraction, the fine ball-milled fraction, additional dispersant, and water in the amounts required for the desired slurry composition. The amounts of the Na and Ca dispersants were changed to vary the ratio of the Na and Ca cations. The weight ratio of Na to Ca dispersant was varied from 1:0 to 0:1 pphc at increments of 0.1 pphc. The consequent Na:Ca molar ratio was varied from 3.9:0 to 0:2.2 mmols/100 g coal. The particular dispersants used were Marasperse CBOs-3, a sodium lignosulfonate containing 3.91% Na and 0.075% Ca by weight, and Norlig 11d, a calcium lignosulfonate containing 2.175% Ca.

The compositions were mixed in a high-shear blender at 6000 rpm at a shear rate of about 1000 $sec^{-1}$.

Results are summarized in Table 1.

With no dispersant, MR-16 has a yield point of 723 dynes/$cm^2$ and a viscosity of 32,500 p at a shear rate of 10 $sec^{-1}$, which make it unusable as a pipeline or fuel slurry. Addition of 0.5 or 1 pphc (comps MR-8 and N11-1 respectively) of the Na dispersant reduces yield point to zero and viscosities to the desirable low values of 5.6 and 4.9 p respectively. Rheology is essentially Newtonian. The slurries, however, have no appreciable static stability, which makes them unfit for use as a fuel.

TABLE 1

| Composition ID | Dispersant Content, pphc: Marasperse CBOs-3 | Dispersant Content, pphc: Norlig 11d | Ion Content, mmols per 100 g Coal: Na | Ion Content, mmols per 100 g Coal: Ca | Na:Ca Molar Ratio | Rheological Constants: Yield Point dynes/$cm^2$ | Rheological Constants: Viscosity, Poise, @ 10 $sec^{-1}$ | Stability Notes: Days | Stability Notes: Observations |
|---|---|---|---|---|---|---|---|---|---|
| MR-16 | 0 | 0 | 0 | 0 | — | 723 | 32,500 | 8 | Thick dough |
| MR-8 | 0.5 | 0 | 2.0 | 0.038 | 53 | 0 | 5.6 | 1 | Unstable* |
| N11-1 | 1.0 | 0 | 3.9 | 0.075 | 52 | 0 | 4.9 | 1 | Unstable* |
| MR-1 | 0.9 | 0.1 | 3.5 | 0.22 | 16 | 0 | 2.9 | 1 | Unstable* |
| MR-2 | 0.8 | 0.2 | 3.1 | 0.44 | 7.0 | 0 | 3.1 | 1 | Unstable* |
| MR-3 | 0.7 | 0.3 | 2.7 | 0.65 | 4.2 | 0 | 2.2 | 1 | Unstable* |
| MR-4 | 0.6 | 0.4 | 2.3 | 0.87 | 2.6 | 1.0 | 3.7 | 12 | Stable** |
| MR-6 | 0.5 | 0.5 | 2.0 | 1.1 | 1.8 | 3.8 | 5.1 | 12 | Stable** |
| MR-7 | 0.4 | 0.6 | 1.6 | 1.3 | 1.2 | 6.9 | 6.3 | 12 | Stable** |
| MR-9 | 0.3 | 0.7 | 1.2 | 1.5 | 0.8 | 14.2 | 9.5 | 11 | Stable** |
| MR-10 | 0.2 | 0.8 | 0.78 | 1.7 | 0.5 | 13.5 | 11.2 | 11 | Stable** |
| MR-11 | 0.1 | 0.9 | 0.39 | 2.0 | 0.2 | 7.8 | 11.3 | 11 | Stable** |
| MR-12 | 0 | 1.0 | 0 | 2.2 | 0 | 12.8 | 10.0 | 10 | Stable** |

TABLE 1-continued

| Composition ID | Dispersant Content, pphc Marasperse CBOs-3 | Norlig 11d | Ion Content, mmols per 100 g Coal Na | Ca | Na:Ca Molar Ratio | Rheological Constants Yield Point dynes/cm$^2$ | Viscosity, Poise, @ 10 sec$^{-1}$ | Stability Notes Days | Observations |
|---|---|---|---|---|---|---|---|---|---|
| MR-13 | 0 | 0.5 | 0 | 1.1 | 0 | 11.4 | 11.5 | 10 | Stable** |

*Separated into supernatant with hard packed sediment.
**Soft non-pourable thixotropic gel with small supernatant and no packed sediment. Comp MR-4 showed soft sediment. All mixes became fluid and pourable with easy stirring.

As shown by slurries MR-12 and 13, addition of the Ca dispersant alone at 1.0 and 0.5 pphc, also reduces viscosity to 9.96 and 11.5 p respectively, but to a substantially lesser degree than the Na dispersant alone. Unlike the Na dispersant slurries, the Ca salt slurries have substantial yield points, 12.8 and 11.4 dynes/cm$^2$ respectively, and long-term stability without hard packed sediment. Thus, the Ca dispersant is functioning both as dispersant and stabilizer.

It can be further seen from the experimental data in Table 1 that when the Na and Ca dispersants are both used in the slurries in relative amounts which vary incrementally and which thereby vary the Na:Ca ion ratios, and the Ca dispersant concentration is sufficient to produce a yield point, both viscosity and yield point are substantially reduced as compared with Ca dispersant alone without sacrificing the long-term static stability essential for a storable fuel slurry.

For example MR-6, a very stable slurry, contains 0.5 pphc of the Na dispersant and 0.5 pphc of the Ca dispersant. Its yield point is 3.8 dynes/cm$^2$ as compared with zero for the MR-8 which contains only 0.5 pphc of Na dispersant and 11.4 dynes/cm$^2$ for the MR-13 which contains about 0.5 pphc Ca dispersant. The viscosity of Comp MR-6 at a shear rate of 10 sec$^{-1}$ is 5.1 p as compared with 5.6 p for MR-8 and 11.5 p for MR-13. In MR-4 relative reduction in yield point and viscosity, with a Na and Ca dispersant pphc ratio of 0.6 to 0.4, is even greater. Stability of this slurry is good, though somewhat less than that of MR-6.

It is interesting to note that an optimum combination of low yield point, low viscosity, and excellent stability is achieved at a Na:Ca ratio of about 2:1 and that excellent stability is maintained with smaller incremental ratios but with increasing viscosities as the proportions of Ca ion increase. The slurries are still stable after 10 to 12 days in storage.

These tests demonstrate the unique properties of the anionic alkaline earth metal salts of an organic dispersant as both dispersants and fuel slurry stabilizers and the improvement in viscosity and reduced yield points obtained when they are combined with anionic alkali metal salts of organic dispersants.

Example 2

A monomodal coal particle size distribution was prepared by dry ball milling crushed "FPL" bituminous coal to a size consist such that 100% was −50M and 70% was −200M. This coal consist is frequently called "boiler grind" and is comparable to state-of-the-art practice for dry direct-firing coal-fired furnaces.

Slurries of 65% coal in water were prepared by admixing the comminuted coal with water, Marasperse CBOs-3 (Na salt) and Norlig 11d (Ca salt) in selected ratios. All of the mixes were subjected to high shear mixing. The results are summarized in Table 2.

TABLE 2

| PARAMETER | COMP ID FPL 34 | MR-8AA | FPL 33 |
|---|---|---|---|
| A. Dispersant Content, pphc | | | |
| Marasperse CBOs-3 | 0.25 | 0.50 | 1.0 |
| Norlig 11d | 0.50 | 0.50 | 0.50 |
| B. Ion Content, mmols/100 g coal | | | |
| Na | 0.98 | 2.0 | 3.9 |
| Ca | 1.1 | 1.1 | 1.2 |
| C. Na:Ca Molar Ratio | 0.88 | 1.8 | 3.3 |
| D. Rheologicals | | | |
| Yield point, dynes/cm$^2$ | 12.8 | 0.5 | 0 |
| Viscosity at a shear rate of 10 sec$^{-1}$, p | 8.9 | 3.3 | 2.9 |
| E. Stability @ 24 Hours | | | |
| Supernatant liquid | Slight | No | Yes |
| Subsidence bed | Non-pourable gel | Pourable | Hard packed |
| Sedimentation | No | Very soft, pourable | |
| Stability at one week | Soft, non-pourable gel; No sediment | Supernatant and soft, restirrable sediment | |
| Stability at two weeks | Medium non-pourable gel; No sediment | Supernatant packed subsidence bed | |

These results clearly show that as the Na:Ca ratio is decreased from 3.4:1, yield point, viscosity and stability are increased. The slurry is stable at 0.88:1; marginal at 1.8:1 and unstable at 3.4:1. It is evident that viscosity and yield point increase significantly with decreasing Na:Ca ratio. Thus, at Na:Ca ratios between 1.8 and 0.88, stable fuel slurries can be obtained at lower viscosities than could be obtained with the Ca dispersant stabilizer alone.

Example 3

A 65 wt.% pipelinable FPL bituminous coal-water slurry was prepared by mixing 39 parts of a coarse fraction crushed to 10M (2000μ)×0 with an MMD of 350μ; 26 parts of a fine coal fraction wet ball milled to 325M (44μ)×0 and an MMD of 7.8μ; 0.0447 parts of Marasperse N22, a sodium lignosulfonate containing 2.91 mmol Na and 0.15 mmol Ca per 100 g coal, and a total of 34.228 parts water.

The coal, water, and Na dispersant were mixed in a Hobart mixer. Viscosity of the mix was 1.5 p at 50 rpm Brookfield. Although the slurry was exceedingly unstable at rest, the very low viscosity obtained with the Na lignosulfonate dispersant makes it useful as a long-distance pipeline slurry.

To the above slurry, 0.325 parts Norlig 11d, a calcium lignosulfonate, were added. The slurry was then charged to an 8⅝ inch diameter ball mill and milled 15 minutes. The resulting slurry was fluid and had a size consist of 99.6% −70M with 76.6% −200M, which is well within the desired particle size range for efficient combustion. Upon standing overnight the slurry exhibited sediment. It was then subjected to high shear mixing at about 6000 rpm in an Oster blender. Before the high shear blending, the yield point of the slurry was 0 and viscosity was 8.15 p at 10 $sec^{-1}$. After the blending the yield point was 21.7 dynes/$cm^2$. Viscosity at 10 $sec^{-1}$ was 21.1 p and 8.15 p at 67 $sec^{-1}$. The slurry was markedly thixotropic and very stable. At rest, it was a soft non-pourable gel with slight supernatant and no sediment after seven days. It became fluid and pourable with easy stirring.

This example demonstrates successful conversion of a pipeline slurry into a stable combustible fuel slurry by: (1) addition of Ca dispersant, (2) milling to the desired reduced size consist, and (3) high shear mixing. In this case the 65% pipeline coal concentration was adequate for efficient use as a fuel. It should be understood that if coal concentration in the pipelinable slurry is inadequate, it can be increased by partial dewatering or addition of dry coal. If the pipeline slurry does not contain dispersant, the alkali metal salt organic dispersant can be added prior to milling, or before or after high shear mixing, preferably before.

This example also demonstrates the importance of high shear mixing in preparation of the stable fuel slurry.

While the present invention has been described by specific embodiments thereof, it should not be limited thereto, since obvious modification will occur to those skilled in the art without departing from the spirit of the invention or the scope of the claims.

I claim:

1. A coal-water fuel slurry which comprises:

a. finely-divided coal having a particle size distribution such that about 100% passes through 50 mesh with at least about 50% passing through 200 mesh, said coal being in amount sufficient to provide a desired coal concentration in the slurry;

b. a minor amount of anionic alkali metal salt organic dispersant sufficient to reduce substantially viscosity of the slurry;

c. a minor amount of anionic alkaline earth metal salt organic dispersant sufficient to produce a slurry yield point larger than that obtained with said alkali metal salt alone and to maintain the slurry in substantially stable static dispersion; and d. water in amount sufficient to provide the liquid carrier for the slurry.

2. The slurry of claim 1 in which at least about 65% passes through 200 mesh.

3. The slurry of claim 2 in which the alkaline earth metal salt dispersant is an organosulfonate.

4. The slurry of claim 3 in which the alkali metal salt dispersant is an organosulfonate.

5. The slurry of claim 3 in which the alkaline earth metal dispersant is a Ca lignosulfonate.

6. The slurry of claim 5 in which the alkali metal dispersant is a Na or K lignosulfonate.

7. The slurry of claim 1 in which the coal particle sizes comprise:

a. fine particles having a maximum size of about 300μ MMD in amount comprising about 10 to 50% by weight of the slurry, and b. larger coal particles within the range of about 20 to 200μ MMD, wherein sub-sieve particle sizes are defined in terms of those obtained by forward scattering optical counter.

8. The slurry of claim 7 in which the fine particles comprise about 10 to 30%.

9. The slurry of claim 7 in which the size of the fine particles is about 1 to 15μ MMD and the range of the larger particles is about 20 to 150 μ MMD.

10. The slurry of claim 8 in which the size of the fine particles is about 1 to 15μ MMD and the range of the larger particles is about 20 to 150μ MMD.

11. The slurry of claim 7 in which the alkaline earth metal dispersant is an organosulfonate.

12. The slurry of claim 8 in which the alkaline earth metal dispersant is an organosulfonate.

13. The slurry of claim 9 in which the alkaline earth metal dispersant is an organosulfonate.

14. The slurry of claim 10 in which the alkaline earth metal dispersant is an organosulfonate.

15. The slurry of claim 11 in which the alkali metal dispersant is a Na or K organosulfonate.

16. The slurry of claim 12 in which the alkali metal dispersant is a Na or K organosulfonate.

17. The slurry of claim 13 in which the alkali metal dispersant is a Na or K organosulfonate.

18. The slurry of claim 14 in which the alkali metal dispersant is a Na or K organosulfonate.

19. The slurry of claim 11 in which the alkaline earth metal dispersant is a Ca lignosulfonate.

20. The slurry of claim 15 in which the alkaline earth metal dispersant is a Ca lignosulfonate.

21. Process for making stable coal-water fuel slurry, which comprises:

a. admixing:

(i) finely-divided coal having a particle size distribution such that about 100% passes through 50 mesh with at least about 50% passing through 200 mesh, said coal being in amount sufficient to provide a desired coal concentration in the slurry;

(ii) a minor amount of anionic alkali metal salt organic dispersant sufficient to reduce substantially viscosity of the slurry;

(iii) a minor amount of anionic alkaline earth metal salt organic dispersant sufficient to produce a slurry yield point larger than that obtained with said alkali metal dispersant alone and to maintain the slurry in substantially stable static dispersion; and (iv) water in amount sufficient to provide the liquid carrier for the slurry, and b. subjecting the mixture to high shear mixing at a shear rate of at least about 100 $sec^{-1}$.

22. The process of claim 21 in which at least about 65% passes through 200 mesh.

23. The process of claim 22 in which the alkaline earth metal dispersant is an organosulfonate.

24. The process of claim 23 in which the alkali metal dispersant is a Na or K organosulfonate.

25. The process of claim 23 in which the organosulfonate is a Ca lignosulfonate.

26. The process of claim 24 in which the organosulfonate is a Ca lignosulfonate.

27. The process of claim 21 in which the coal particle sizes comprise:

a. fine particles having a maximum size of about 30μ MMD in amount comprising about 10 to 50% by weight of the slurry; and b. larger coal particles within the range of about 20 to 200μ MMD;

wherein sub-sieve particle sizes are defined in terms of those obtained by forward scattering optical counter.

28. The process of claim 27 in which the fine particles comprise about 10 to 30%.

29. The process of claim 27 in which the size of the fine particles is about 1 to 15μ MMD and the range of the larger particles is about 20 to 150μ MMD.

30. The process of claim 28 in which the size of the fine particles is about 1 to 15μ MMD and the range of the larger particles is about 20 to 150μ MMD.

31. The process of claim 27 in which the alkaline earth metal dispersant is an organosulfonate.

32. The process of claim 28 in which the alkaline earth metal dispersant is an organosulfonate.

33. The process of claim 29 in which the alkaline earth metal dispersant is an organosulfonate.

34. The process of claim 30 in which the alkaline earth metal dispersant is an organosulfonate.

35. The process of claim 31 in which the alkali metal dispersant is a Na or K organosulfonate.

36. The process of claim 32 in which the alkali metal dispersant is a Na or K organosulfonate.

37. The process of claim 33 in which the alkali metal dispersant is a Na or K organosulfonate.

38. The process of claim 34 in which the alkali metal dispersant is a Na or K organosulfonate.

39. The process of claim 31 in which the alkaline earth metal dispersant is a Ca lignosulfonate.

40. The process of claim 35 in which the alkaline earth metal dispersant is a Ca lignosulfonate.

41. Process for converting a coal-water pipeline slurry into a substantially stable fuel slurry, wherein the pipeline slurry contains particles of excessive size for efficient combustion, which comprises:

a. partially dewatering or adding finely-divided coal in an amount sufficient to increase the coal content in the pipeline slurry to a concentration desired in the fuel slurry, if the coal concentration in the aqueous pipeline slurry is less than that desired in the fuel slurry;

b. passing said slurry through a comminuting means to reduce excessively sized coal particles to sizes sufficiently small for combustion in a combustion chamber and to produce a particle size distribution such that about 100% passes through 50 mesh with at least about 50% passing through 200 mesh;

c. adding to the slurry a minor amount of:

(i) anionic alkali metal salt organic dispersant sufficient to reduce substantially viscosity of the slurry, and (ii) alkaline earth metal salt organic dispersant sufficient to produce a slurry yield point larger than that produced with said alkali metal dispersant alone and to maintain the slurry in substantially stable static dispersion; and d. subjecting the mixture comprising said coal, said alkali metal and alkaline earth metal dispersants and water to high shear mixing at a shear rate of at least about 100 $sec^{-1}$.

42. The process of claim 41 in which at least about some of the alkali metal dispersant is a component of the pipeline slurry.

43. The process of claim 41 in which at least 65% passes through 200 mesh.

44. The process of claim 42 in which at least 65% passes through 200 mesh.

45. The process of claim 41 in which the alkaline earth metal salt is an organosulfonate.

46. The process of claim 42 in which the alkaline earth metal salt is an organosulfonate.

47. The process of claim 43 in which the alkaline earth metal salt is an organosulfonate.

48. The process of claim 44 in which the alkaline earth metal salt is an organosulfonate.

49. The process of claim 45 in which the organosulfonate is a Ca lignosulfonate.

50. The process of claim 46 in which the organosulfonate is a Ca lignosulfonate.

51. The process of claim 47 in which the organosulfonate is a Ca lignosulfonate.

52. The process of claim 48 in which the organosulfonate is a Ca lignosulfonate.

53. The process of claim 45 in which the alkali metal dispersant is a Na or K organosulfonate.

54. The process of claim 46 in which the alkali metal dispersant is a Na or K organosulfonate.

55. The process of claim 47 in which the alkali metal dispersant is a Na or K organosulfonate.

56. The process of claim 48 in which the alkali metal dispersant is a Na or K organosulfonate.

57. The process of claim 49 in which the alkali metal dispersant is a Na or K lignosulfonate.

58. The process of claim 50 in which the alkali metal dispersant is a Na or K lignosulfonate.

59. The process of claim 51 in which the alkali metal dispersant is a Na or K lignosulfonate.

60. The process of claim 52 in which the alkali metal dispersant is a Na or K lignosulfonate.

61. A coal-water fuel slurry which comprises:

a. finely divided coal having a particle size distribution such that about 100% passes through 50 mesh with at least about 50% passing through 200 mesh, said coal being in amount sufficient to provide a desired coal concentration in the slurry;

b. a minor amount of anionic monovalent cation salt organic dispersant sufficient to reduce substantially viscosity of the slurry;

c. a minor amount of anionic alkaline earth metal salt organic dispersant sufficient to produce a slurry yield point larger than that obtained with said monovalent cation salt alone and to maintain the slurry in substantially stable static dispersion; and d. water in amount sufficient to provide the liquid carrier for the slurry.

62. The slurry of claim 61 in which the coal particle sizes comprise:

a. fine particles having a maximum size of about 30μ MMD in amount comprising about 10 to 50% by weight of the slurry, and b. larger coal particles within the range of about 20 to 200μ MMD, wherein sub-sieve particle sizes are defined in terms of those obtained by forward scattering optical counter.

63. Process for making substantially stable coal-water fuel slurry, which comprises:

a. admixing:

(i) finely divided coal having a particle size distribution such that about 100% passes through 50 mesh with at least about 50% passing through 200 mesh, said coal being in amount sufficient to provide a desired coal concentration in the slurry;

(ii) a minor amount of anionic monovalent cation salt organic dispersant sufficient to reduce substantially viscosity of the slurry;

(iii) a minor amount of anionic alkaline earth metal salt organic dispersant sufficient to produce a slurry yield point larger than that obtained with a monovalent cation salt dispersant alone and to maintain the slurry in substantially stable static dispersion; and (iv) water in amount sufficient to provide the liquid carrier for the slurry, and b. subjecting the mixture to high shear mixing at a shear rate of at least about 100 sec.$^{-1}$.

64. The process of claim 63 in which the coal particle sizes comprise:

a. fine particles having a maximum size of about 30μ MMD in amount comprising about 10 to 50% by weight of the slurry; and b. larger coal particles within the range of about 20 to 200μ MMD;

wherein sub-sieve particle sizes are defined in terms of those obtained by forward scattering optical counter.

65. Process for converting a coal-water pipeline slurry into a substantially stable fuel slurry, wherein the pipeline slurry contains particles of excessive size for efficient combustion, which comprises:

a. partially dewatering or adding finely-divided coal in an amount sufficient to increase the coal content in the pipeline slurry to a concentration desired in the fuel slurry, if the coal concentration in the aqueous pipeline slurry is less than that desired in the fuel slurry;

b. passing said slurry through a comminuting means to reduce excessively sized coal particles to sizes sufficiently small for combustion in a combustion chamber and to produce a particle size distribution such that about 100% passes through 50 mesh with at least about 50% passing through 200 mesh;

c. adding to the slurry a minor amount of:

(i) anionic monovalent cation salt organic dispersant sufficient to reduce substantially viscosity of the slurry, and (ii) alkaline earth metal salt organic dispersant sufficient to produce a slurry yield point larger than that produced with said cationic monovalent salt dispersant alone and to maintain the slurry in substantially stable static dispersion; and subjecting the mixture comprising said coal, said monovalent cationic and alkaline earth metal dispersants and water to high shear mixing at a shear rate of at least about 100 sec$^{-1}$.

66. A coal-water fuel slurry which comprises:

a. finely-divided coal having a particle size distribution within efficient combustion size range, said coal being in amount sufficient to provide a desired coal concentration in the slurry;

b. a minor amount of anionic alkali metal salt organic dispersant sufficient to reduce substantially viscosity of the slurry;

c. a minor amount of anionic alkaline earth metal salt organic dispersant sufficient to produce a slurry yield point larger than that obtained with said alkali metal salt alone and to maintain the slurry in stable static dispersion; and d. water in amount sufficient to provide the liquid carrier for the slurry.

67. Process for making stable coal-water fuel slurry, which comprises:

a. admixing:

(i) finely-divided coal having a particle size distribution within efficient combustion size range, said coal being in amount sufficient to provide a desired coal concentration in the slurry;

(ii) a minor amount of anionic alkali metal salt organic dispersant sufficient to reduce substantially viscosity of the slurry;

(iii) a minor amount of anionic alkaline earth metal salt organic dispersant sufficient to produce a slurry yield point larger than that obtained with said alkali metal dispersant alone and to maintain the slurry in stable static dispersion; and (iv) water in amount sufficient to provide the liquid carrier for the slurry, and b. subjecting the mixture to high shear mixing at a shear rate of at least about 100 sec$^{-1}$.

68. Process for converting a coal-water pipeline slurry into a substantially stable fuel slurry, wherein the pipeline slurry contains particles of excessive size for efficient combustion, which comprises:

a. partially dewatering or adding finely-divided coal in an amount sufficient to increase the coal content in the pipeline slurry to a concentration desired in the fuel slurry, if the coal concentration in the aqueous pipeline slurry is less than that desired in the fuel slurry;

b. passing said slurry through a comminuting means to reduce excessively sized coal particles to sizes sufficiently small for efficient combustion in a combustion chamber;

c. adding to the slurry a minor amount of:

(i) anionic alkali metal salt organic dispersant sufficient to reduce substantially viscosity of the slurry, and (ii) alkaline earth metal salt organic dispersant sufficient to produce a slurry yield point larger than that produced with said alkali metal dispersant alone and to maintain the slurry in substantially stable static dispersion; and d. subjecting the mixture comprising said coal, said alkali metal and alkaline earth metal dispersants and water to high shear mixing at a shear rate of at least about 100 sec$^{-1}$.

* * * * *